United States Patent [19]

Emmons

[11] 4,193,476

[45] Mar. 18, 1980

[54] LINK LADDER

[76] Inventor: Jerry D. Emmons, Box 53, Ochelata, Okla. 74051

[21] Appl. No.: 941,232

[22] Filed: Sep. 11, 1978

[51] Int. Cl.[2] ..... E06C 1/36; E06C 1/52; E06C 5/30

[52] U.S. Cl. ..... 182/164; 182/46; 182/189; 182/206

[58] Field of Search ..... 182/196, 189, 100, 41, 182/43, 206, 163, 164

[56] References Cited

U.S. PATENT DOCUMENTS

| | | | |
|---|---|---|---|
| 277,222 | 5/1883 | Bush | 182/196 |
| 620,902 | 3/1899 | Fabe | 182/43 |
| 774,470 | 11/1904 | Hamilton | 182/41 |

*Primary Examiner*—Reinaldo P. Machado

*Attorney, Agent, or Firm*—Head & Johnson

[57] ABSTRACT

A multi-purpose, lightweight, portable ladder comprising a plurality of link elements pivotally secured together in end-to-end relation, each link being of a substantially A-shaped configuration wherein one end of a first link is disposed between the legs of the next succeeding link and the two links are pinned together for relative rotation movement about the axis of the pin whereby the ladder may be folded or rolled into a relatively small configuration during periods of non-use. A hook member is secured to the outer end of the leading link in the chain of the ladder for facilitating securing of the ladder in a substantially vertical position, and the last link in the chain may be securely anchored to the ground for holding the ladder in the vertical position during periods of use.

5 Claims, 5 Drawing Figures

LINK LADDER

BACKGROUND OF THE INVENTION

1. Field of the Invention

This invention relates to improvements in ladders and more particularly, but not by way of limitation, to a portable ladder which may be collapsed into a relatively small package when not in use and readily extended for use.

2. Description of the Prior Art

It is frequently desirable or necessary to climb heights at locations wherein the usual or normal ladder may not be readily available. For example, during a camping trip, or the like, it may be desirable to climb to a relatively great height in a tree for retrieval of fire wood, and the tree may not be of a type which lends itself to the climb. Under such conditions it would be highly desirable to have a ladder at hand, but many of these locations are somewhat remote, and since the normal ladder is not usually considered as a portable device in the manner that one might always store the ladder in camping gear, or the like, a ladder is usually not available for use. Portable and collapsible ladders have been developed for overcoming the disadvantages of the usual relatively rigid ladder, such as those shown in the J. Dennis U.S. Pat. No. 2,905,264, issued Sept. 22, 1959 and entitled "Composite Link Structures for Collapsible Ladders, Conveyors, or the Like" and the G. A. Phillips U.S. Pat. No. 1,603,638, issued Oct. 19, 1926, and entitled "Ladder". These devices have certain disadvantages, however, in that strength of the link sturctures and the connecting elements therebetween may not be sufficient to withstand the normal usage of a ladder of this type.

SUMMARY OF THE INVENTION

The present invention contemplates a novel portable and collapsible ladder comprising a plurality of substantially identical link members pinned together in end-to-end relation whereby the ladder may be folded or rolled about a spool or the like for storage and portability when not in use, and readily extended during periods of use. Each link is provided with stop means cooperating with the adjacent link for permitting relative pivoting of the links in one direction and precluding relative pivoting of the links in an opposite direction, thus assuring a rigidity for the ladder in the extended position thereof. The links are of a substantially A-shaped configuration, with the head of the "A" being provided with a bore extending therethrough substantially parallel with the plane of the "A", and the spaced legs of the "A" are provided with axially aligned bores. The head of one link is disposed between the spaced legs of the next succeeding link and a pin member is inserted through the bores of the legs and the bore of the head member for pivotally securing the adjacent links together in end-to-end relation. The leading link in the chain is provided with a suitable hook member for facilitating fastening the ladder in position for use, and the trailing link of the chain may be securely anchored to the ground, or the like, for securely retaining the ladder in the position for use. The novel ladder is simple and efficient in use and economical and durable in construction.

DESCRIPTION OF THE PREFERRED EMBODIMENT

Figure 2:
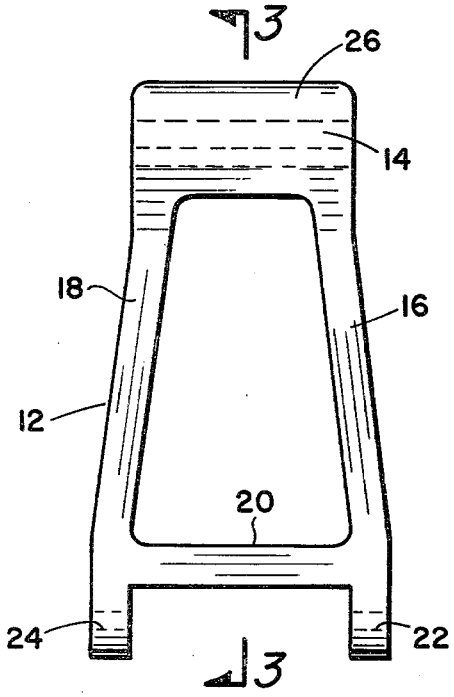
FIG. 2 is an elevational view of a link member utilized in a ladder embodying the invention.

Referring to the drawings in detail, reference character 10 generally indicates a link ladder comprising a plurality of substantially identical link members 12 pivotally secured together in end-to-end relation. Each link 12 is of a substantially A-shaped configuration, as particularly shown in FIG. 2 and includes a head member 14 having a pair of spaced leg members 16 and 18 extending outwardly from one side edge thereof. A step member or cross member 20 extends between the legs 16 and 18 and is spaced inwardly from the outer ends thereof to provide a rung for the ladder 10. In addition, each leg 16 and 18 is provided with a bore 22 and 24, respectively, interposed between the outer ends thereof and the step member 20 and disposed in substantial axial alignment for a purpose as will be hereinafter set forth.

Figure 3:
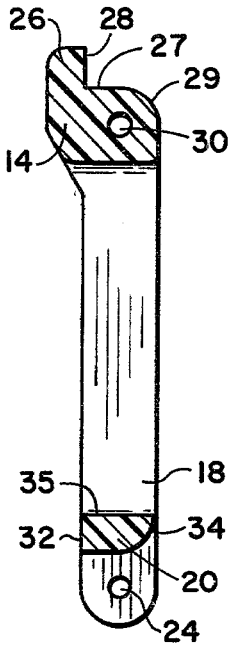
FIG. 3 is a view taken on line 3—3 of FIG. 2.
Figure 5:
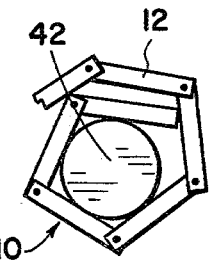
FIG. 5 is a sectional elevational view of a spool having a ladder embodying the invention wound thereon.

The head member 14 is of a substantially L-shaped cross-sectional configuration and is provided with an outwardly extending flange 26 along one edge thereof forming one leg of the "L". The flange 26 is oppositely disposed with respect to the legs 16 and 18 to provide an outwardly extending substantially straight shoulder 28, the plane of which is substantially perpendicular to the outer edge 27 of the head 14, as particularly shown in FIG. 3. The outer edge of the other leg of the "L" is of an arcuate cross-sectional configuration as shown at 29 for a purpose as will be hereinafter set forth. In addition, a bore 30 extends longitudinally through the head 14 and is in spaced relation to the shoulder 28 as shown in FIG. 3. The axis of the bore 30 is preferably in substantial alignment with the plane of the A-shaped link member 14.

The step member 20 is provided with one substantially straight edge 32 which is preferably in substantial planar alignment with the shoulder 28. The opposite edge 34 of the step member 20 is of an arcuate cross-section configuration for cooperating with the arcuate edge 29 to facilitate the folding of the ladder 10 as will be hereinafter set forth in detail. The inner surface 35 of the step 20 is substantially flat for supporting the foot of a person using the ladder 10.

The leading link 12A in the chain of the ladder 10 is provided with a bore 36 (FIG. 1) extending through the head thereof substantially perpendicular to the bore 30 for receiving one end of a suitable hook member 38 therethrough. The hook 38 may be rigidly secured in the bore 36, if desired, or may be freely journalled therein in any suitable manner for rotation of the hook 38 with respect to the link member 12A.

Figure 1:
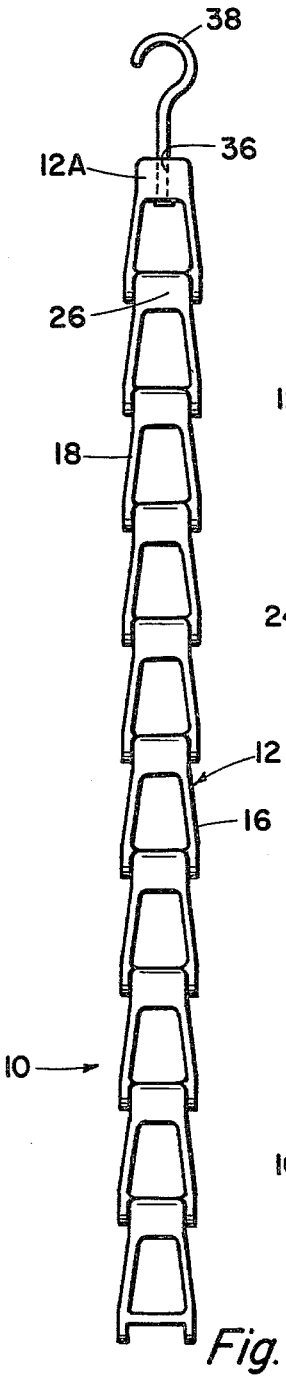
FIG. 1 is an elevational view of a link ladder embodying the invention.
Figure 4:
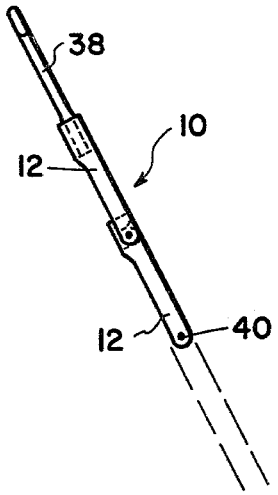
FIG. 4 is a side elevational view of the leading link and next succeeding link in a ladder embodying the invention and illustrated in a position for use.

The ladder 10 may be of substantially any desired length and is constructed by pinning or otherwise securing a plurality of the links 12 in end-to-end relation as shown in FIGS. 1 and 4. In order to assemble the ladder 10, the head member 14 of one link member 12 may be disposed between the outer ends of the leg members 16 and 18 of the next succeeding link member 12, with the bore 30 of the first link being disposed in substantial alignment with the bores 22 and 24 of the second link member. A suitable pin member 40 may be inserted thorugh the aligned bores 22, 30 and 24 and secured therein in any well known manner (not shown) for securing the two links together in a manner providing for independent pivoting of each link about the axis of the pin 40. The arcuate configuration of the edge 34 of the step member 20 of each link 12 cooperates with the arcuate edge 29 of the adjacent link member 12 for facilitating pivoting of the link members in one direction about the pin 40, whereas the edge 32 of the step member 20 of one link 12 abuts or engages the shoulder 28 of the adjacent link 12 for precluding pivoting of the link members in an opposite direction about the pin 40.

The link members 12 may be constructed from any suitable material, but are preferably constructed from hard nylon, or other suitable plastic material, and the pins 40 and hook 38 are preferably constructed from a tempered aluminum, or the like, but not limited thereto.

In use, the ladder 10 is extended, as particularly shown in FIGS. 1 and 4, and disposed or oriented in such a manner that the links 12 may be pivoted only in a direction considered as upward when the ladder 10 is in a normal inclined position for use. The hook 38 may be manually engaged with the object wherein the climbing action is required, thus supporting the ladder 10 in an angled upright position. The last link 12 of the ladder may then be anchored in any suitable manner, such as by tying, or staking down to the ground. In this position, the ladder will be substantially erect and will not fold or collapse as a person steps on the rungs 20 during a ladder climbing operation.

When the ladder is not in use, it may be collapsed or folded in a reverse direction from the use position hereinbefore set forth, whereupon the ladder may be rolled around the outer periphery of a spool 42, or the like, for storage.

From the foregoing, it will be apparent that the present invention provides a novel foldable or collapsible ladder comprising a plurality of link members pivotally secured together in end-to-end relation in a manner providing for pivoting of the links about common pin members in one direction and rigidly held against independent pivoting in an opposite direction. The ladder may be easily extended and anchored in a use position, and easily folded or collapsed for a storage position when not in use.

Whereas the present invention has been described in particular relation to the drawings attached hereto, it should be understood that other and further modifications, apart from those shown or suggested herein may be made within the spirit and scope of this invention.

What is claimed is:

1. A collapsible ladder comprising a plurality of link members pivotally secured in end-to-end relation abutment, means provided on each link member for cooperating with the adjacent link member to preclude relative rotation therebetween in one direction, arcuate means provided on each link member for cooperating with the adjacent link member for facilitating relative rotation therebetween in an opposite direction for collapsing of the ladder during periods of non-use, engagement means provided on at least one link member for securing the ladder during periods of use, and wherein each link member is substantially A-shaped configuration whereby the head of the "A" of one link may be disposed between the legs of the adjacent link member for securing the links in said end-to-end relation, and wherein the cross bar of the "A" of each link member provides a rung for the ladder.

2. A collapsible ladder as set forth in claim 1 wherein the cross bar of the "A" of each link member is provided with at least one arcuate edge for facilitating relative rotation between adjacent link members.

3. A collapsible ladder as set forth in claim 2 wherein the head of the "A" of each link member is provided with at least one arcuate edge for cooperation with the arcuate edge of the cross bar of the "A" of the adjacent link member for facilitating said relative rotation therebetween.

4. A collapsible ladder as set forth in claim 1 wherein each cross bar includes at least one abutment surface engageable with the head of the "A" of an adjacent link member for precluding relative rotation therebetween in said one direction.

5. A collapsible ladder as set forth in claim 4 wherein the head of the "A" of each link member is provided with at least one abutment surface engageable with the abutment surface of the cross bar of the adjacent link member for precluding relative rotation therebetween in said one direction.

* * * * *